US009080418B2

(12) United States Patent
Shaikh et al.

(10) Patent No.: US 9,080,418 B2
(45) Date of Patent: Jul. 14, 2015

(54) DIRTY FLUID VALVE WITH CHEVRON SEAL

(75) Inventors: Farhat A. Shaikh, Houston, TX (US); Marcelo F. Civarolo, The Woodlands, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 761 days.

(21) Appl. No.: 13/358,251

(22) Filed: Jan. 25, 2012

(65) Prior Publication Data

US 2013/0186621 A1 Jul. 25, 2013

(51) Int. Cl.

| | |
|---|---|
| ***E21B 49/08*** | (2006.01) |
| ***E21B 34/14*** | (2006.01) |
| ***E21B 33/12*** | (2006.01) |
| *E21B 33/00* | (2006.01) |
| *E21B 34/00* | (2006.01) |

(52) U.S. Cl.

CPC ..... *E21B 34/14* (2013.01); *E21B 33/1208* (2013.01); *E21B 2033/005* (2013.01); *E21B 2034/007* (2013.01)

(58) Field of Classification Search

CPC ..... E21B 2033/005; E21B 33/1208; E21B 34/10; E21B 49/08

USPC ..... 166/264, 374, 334.4, 321; 73/152.6

See application file for complete search history.

(56) References Cited

U.S. PATENT DOCUMENTS

| | | | | |
|---|---|---|---|---|
| 4,069,865 | A | 1/1978 | Gazda et al. | |
| 4,076,077 | A | 2/1978 | Nix et al. | |
| 4,149,593 | A | 4/1979 | Gazda et al. | |
| 4,406,469 | A | 9/1983 | Allison | |
| 4,928,761 | A | 5/1990 | Gazda et al. | |
| 5,156,220 | A | 10/1992 | Forehand et al. | |
| 5,309,993 | A * | 5/1994 | Coon et al. | 166/115 |
| 5,316,084 | A | 5/1994 | Murray et al. | |
| 5,509,476 | A | 4/1996 | Vick, Jr. | |
| 6,702,024 | B2 | 3/2004 | Neugebauer | |
| 7,073,590 | B2 * | 7/2006 | Neugebauer et al. | 166/321 |
| 7,373,973 | B2 | 5/2008 | Smith et al. | |
| 7,401,788 | B2 | 7/2008 | Williams et al. | |
| 7,445,047 | B2 * | 11/2008 | Gomez | 166/334.4 |
| 7,472,756 | B2 | 1/2009 | Wong | |
| 2014/0124193 | A1 * | 5/2014 | Rowe et al. | 166/115 |

OTHER PUBLICATIONS

PCT/US2012/072064—International Search Report dated Apr. 5, 2013.

* cited by examiner

*Primary Examiner* — Jennifer H Gay

*Assistant Examiner* — George Gray

(74) *Attorney, Agent, or Firm* — Mossman, Kumar & Tyler, PC

(57) ABSTRACT

An apparatus for controlling a fluid flow in a borehole may include a tool body that retrieves a fluid sample from a subsurface formation. The tool body has a fluid conduit having an inlet for receiving the fluid sample and an outlet for conveying the fluid sample to a selected location. A mandrel selectively blocks flow across the fluid conduit; and a seal disposed on the mandrel includes at least one chevron seal element that cooperates with the mandrel to selectively block flow across the fluid conduit.

19 Claims, 3 Drawing Sheets

DIRTY FLUID VALVE WITH CHEVRON SEAL

CROSS REFERENCE TO RELATED APPLICATIONS

None.

FIELD OF THE DISCLOSURE

This disclosure pertains generally to flow control devices such as valves.

BACKGROUND OF THE DISCLOSURE

During the drilling and completion of oil and gas wells, the downhole environment can impose substantial operational stresses on downhole equipment. These harsh conditions exposure to drilling mud, contaminants entrained in well fluids, and hydraulic forces of the circulating drilling mud. Extreme pressures and temperatures may also be present. Such harsh conditions can damage and degrade downhole equipment. Valves used in sampling, drilling, and completion operations may be susceptible to the harsh downhole conditions because they require the use of seals and moving parts. For example, valves used in a downhole environment may interact with deleterious debris carried by formation fluids and encounter significant pressure drops.

The present disclosure addresses the need for sealing high differential pressure in a downhole environment, as well as in surface applications.

SUMMARY OF THE DISCLOSURE

In aspects, the present disclosure provides an apparatus for controlling a fluid flow in a borehole. The apparatus may include a tool body configured to retrieve a fluid sample from a subsurface formation, the tool body having a fluid conduit having an inlet for receiving the fluid sample and an outlet for conveying the fluid sample to a selected location; a mandrel selectively blocking flow across the fluid conduit; and a seal disposed on the mandrel, the seal including at least one chevron seal element configured to cooperate with the mandrel to selectively block flow across the fluid conduit.

In another embodiment, the apparatus may include a carrier configured to be conveyed along a borehole; a tool body positioned along the carrier, the tool body having at least one packer configured to form an isolated zone, the tool body having a fluid conduit having an inlet for receiving a fluid sample from the isolated zone and an outlet for conveying the fluid sample to a selected location; and a valve disposed in the tool body. The valve may include a mandrel configured to translate between a first and a second position to selectively block flow across the fluid conduit; and a seal disposed on the mandrel, the seal including at least one chevron seal element configured to cooperate with the mandrel to selectively block flow across the fluid conduit.

In another aspect, the present disclosure provides a method for controlling a fluid flow. The method may include retrieving a fluid sample from a subsurface formation using a tool body, the tool body having a fluid conduit having an inlet for receiving the fluid sample and an outlet for conveying the fluid sample to a selected location; selectively blocking flow across the fluid conduit using a mandrel; and isolating the inlet from the outlet using a seal positioned in a passage between the mandrel and the tool body, the seal including at least one chevron seal element.

Thus, the present disclosure provides seals that enhance control, operation, service life, reliability, and/or performance for valves and other flow control devices. The teachings may be applied to a variety of systems both in the oil and gas industry and elsewhere.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

In aspects, the present disclosure provides a "dirty" fluid valve with a bi-directional Chevron type metal seal assembly for use in tool used to sample wellbore fluids and to store such fluids in a sample bottle. The valve may be pressure balanced and may be operated in varying pressures. The seals described herein provide gas tight seal for repeated operations.

Figure 1A:
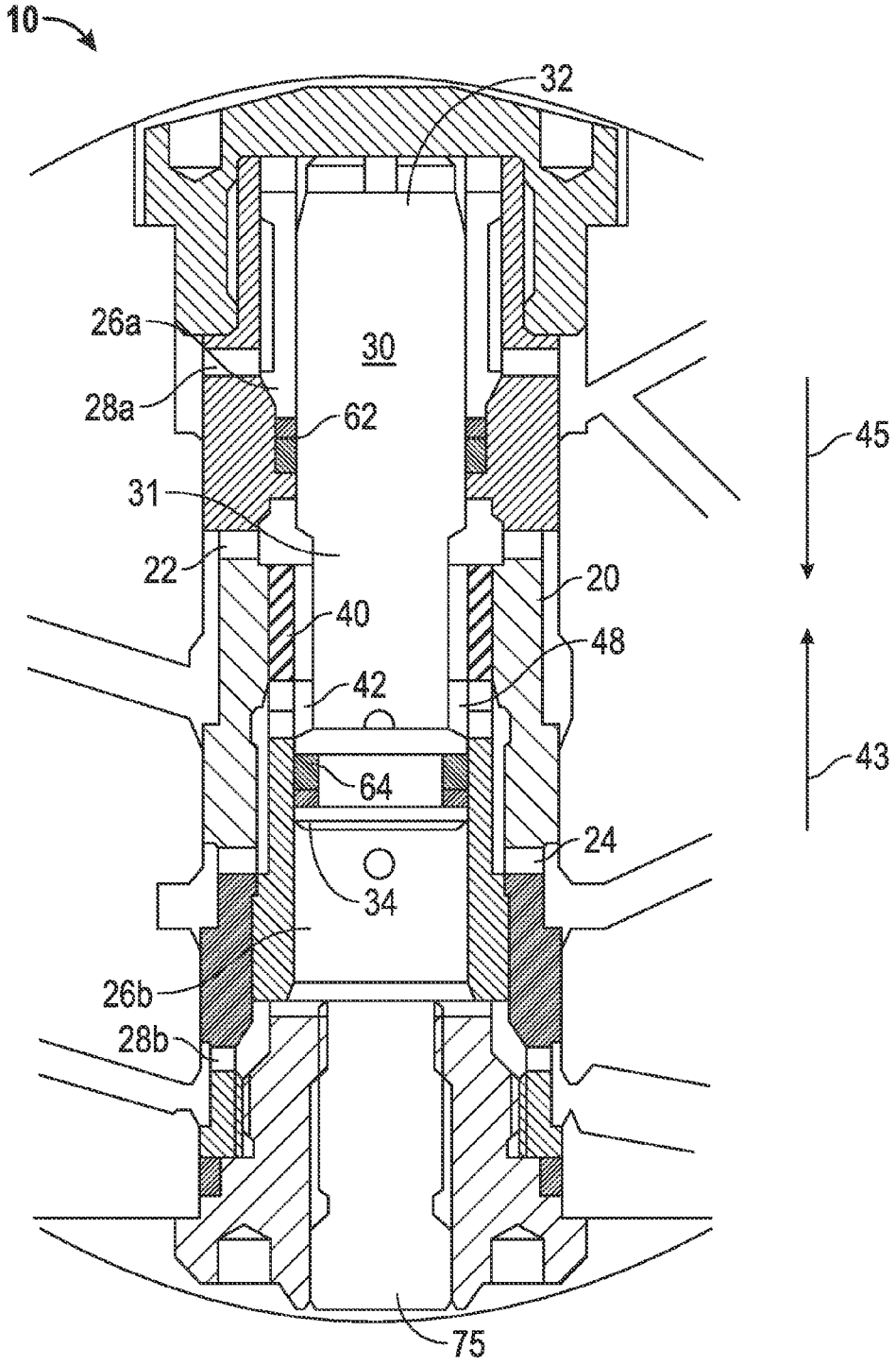
FIGS. 1A and 1B shows sectional views of a valve according to one embodiment of the present disclosure in the open and closed positions, respectively.
Figure 1B:
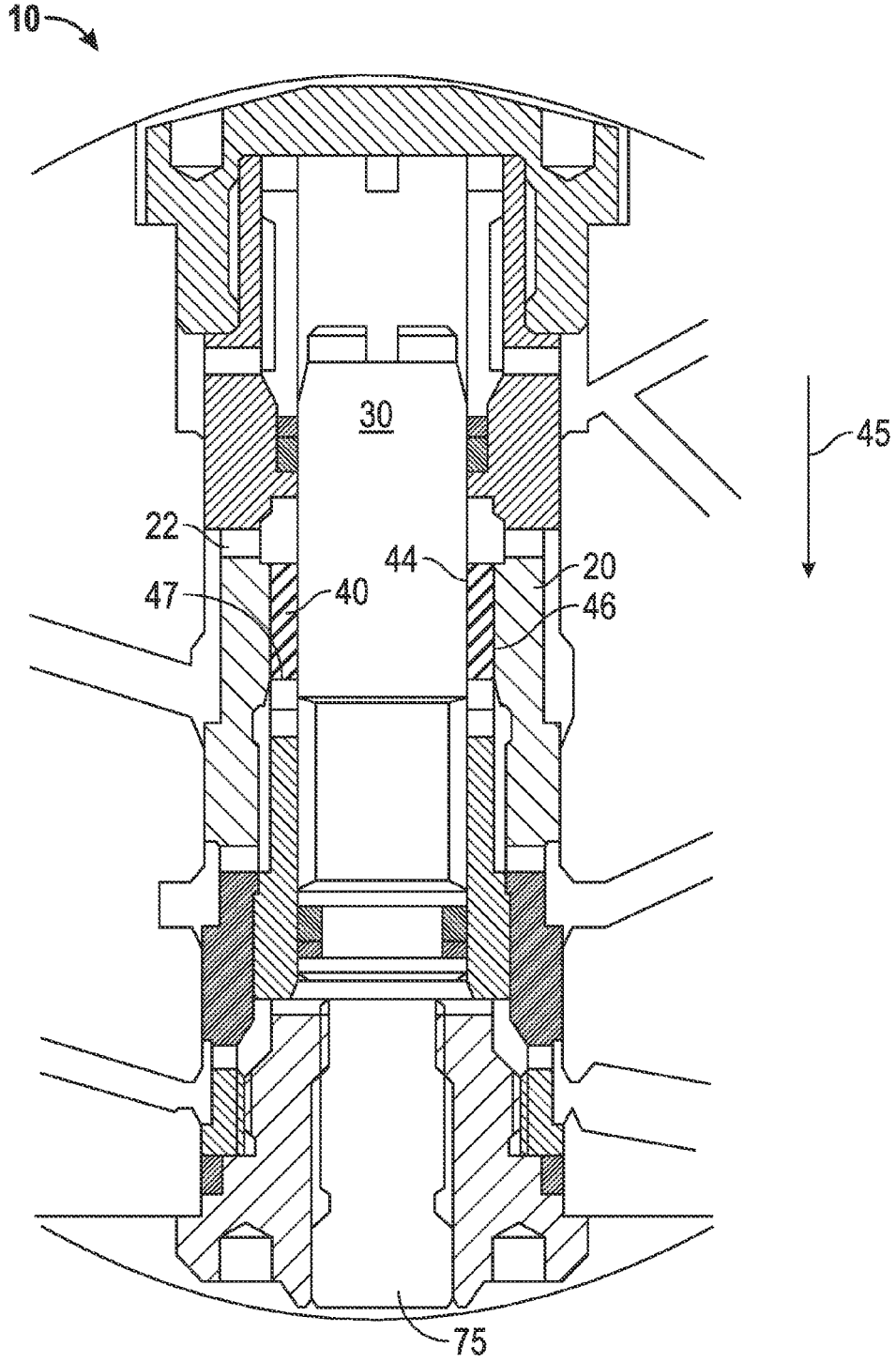

Referring initially to FIGS. 1A and 1B, there is shown a valve assembly 10 that may be used to retrieve fluid samples from a formation. The valve assembly 10 may include a body or housing 20 in which a mandrel 30 and a seal 40 are disposed. The housing 20 may include a fluid inlet 22, a fluid outlet 24, pressure chambers 26*a, b*, and pilot holes 28*a, b*. The pressure chamber 26*a* is positioned next to a first end 32 of the mandrel 30 and the pressure chamber 26*b* is positioned next to a second end 34 of the mandrel 30. The housing 20 may be unitary or composed of several components. Therefore, it should be understood that the depicted configuration is merely illustrative and does not limit the present disclosure.

In one embodiment, fluid communication between the fluid inlet 22 and the fluid outlet 24 may be controlled by shifting or translating the mandrel 30 in a cavity 42 of the housing 20. The mandrel 30 may be a cylindrical member that includes a reduced diameter or "necked" portion 31. When the mandrel 30 is set in the open position, the necked portion 31 forms an annular passage 48 in the housing that 20 that connects the fluid inlet 22 with the fluid outlet 24. Thus, the inlet 22, the passage 42, and the outlet 24 may be considered as forming a fluid conduit in the housing 20. Seals 62, 64 between the mandrel 30 and the housing 20 isolate the passage 48 from the rest of the valve 10. To shift the mandrel 30 to the open position, the pressure chamber 26*b* is pressurized using the pilot inlet 28*b* to urge the mandrel 30 in an axial direction marked with arrow 43. To shift the mandrel 30 to the closed position, the pressure chamber 26*a* is pressurized using the pilot inlet 28*a* with a hydraulic fluid to urge the mandrel 30 in an axial direction marked with arrow 45, which is directionally opposite to arrow 43.

Referring now to FIG. 1A, the valve assembly 10 is shown in an open position wherein the fluid inlet 22 and the fluid outlet 24 are in fluid communication via a passage 48 in the housing 20. Applying pressurized hydraulic fluid to the pressure chamber 26*a* slides the mandrel 30 in the axial direction 44 until the mandrel 30 reaches the closed position shown in FIG. 1B. In FIG. 1B, the seal 40 and the mandrel 30 form a fluid seal (e.g., liquid-tight seal or gas-tight seal) that prevents fluid communication between the fluid inlet 22 and the fluid outlet 24.

Referring to FIG. 1B, the seal 40 may be a bidirectional sealing device that includes one or more sealing elements that form a flow-blocking barrier between an outer surface 44 of the mandrel 30 and an inner surface 46 of the housing 20. The seal 40 may be bidirectional in that the seal prevents flow therethrough in either axial direction. The seal 40 surrounds the mandrel 30 and is stationary relative to the housing 20. For example, the seal 40 may seat on a support 47 of the housing 20. The support 47 may be a shoulder or ledge that limits axial movement of the seal 40. The support 47 may be integral with the housing 20 or tubular component of the housing 20.

Figure 2:
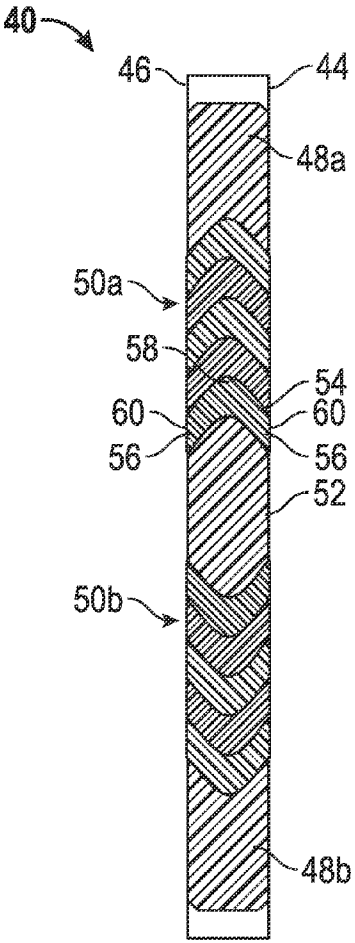
FIG. 2 shows a seal in accordance with one embodiment of the present disclosure.

Referring now to FIG. 2, there is shown a cross-sectional view of a section of one embodiment of a seal 40 in accordance with the present disclosure. In one arrangement, the seal 40 may include an upper end adapter 48*a*, a first unidirectional seal stack 50*a*, a center adapter 52, a second unidirectional seal stack 50*b*, and a second end adapter 48*b*. The end adapters 48*a,b* and the center adapter 52 may be formed of a material harder or more rigid than the material of the seal rings 54 so that pressure applied to the end adapters 48*a, b* can be distributed relatively evenly through the seal stacks 50*a,b*.

The unidirectional seal ring stacks 50*a, b* may include one or more cylindrical seal rings 54. The seal rings 54 may be formed as chevron-type seal rings. As used herein, a chevron seal ring is a pressure responsive sealing element that flexes to form a seal against adjacent surfaces. The chevron shape may defined by two wings 56 that are hinged at an apex 58. The wings 56 may form an angle less than one-hundred eighty degrees. The seal ring 54 is responsive to the pressure applied on the apex 58 side (i.e., unidirectional). In one embodiment, the seal rings 54 may be "U" or "V" shaped annular elements formed of a material that allows a predetermined amount of flexure when the ring 54 is compressed. Thus, pressure applied to the upper end adapter 48*a* causes the ring(s) 54 to be compressed against the center adapter 52. This compression causes the ring(s) 54 to expand and compress the tips 60 of the wings 56 to engage and seal against the adjacent surfaces 44, 46.

It should be appreciated that seal 40 is pressure responsive in that the magnitude of the sealing force (or contact force) at the tips 60 varies directly with the differential pressure across the seal 40. Thus, as this pressure differential increases, the sealing force at the tips 60 also increases. In the embodiment shown, the seal 40 includes multiple oppositely-oriented rings 54. The use of multiple rings 54 allows the formation of multiple serially aligned sealing surfaces along the surfaces 44, 46. The opposite orientation of the seal rings 54, i.e., having the apexes 58 point in opposite directions, enables the seal 40 to be bidirectional.

The rings 54 may be formed of a material that has a modulus that allows flexure at a prescribed pressure range. In some embodiments, a metal such as spring steel may be used. In other embodiments, non-metals such as elastomeric material may used. In still other embodiments, the seal stacks 50*a, b* may use a combination of two or more materials. For example, seal stacks 50*a, b* may include one or more rings 54 made of metal and one or more rings made of a non-metal. Also, while several rings 54 are shown for each of seal stack 50*a, b*, one or more rings may be used.

Figure 3:
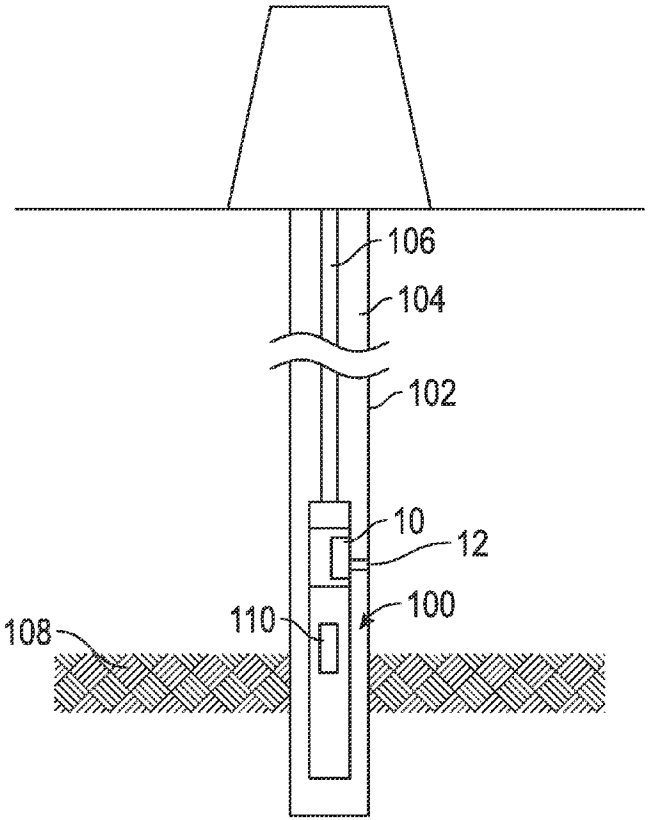
FIG. 3 schematically shows a well system that uses a valve according to one embodiment of the present disclosure in a borehole formed in an earthen formation.

Referring to FIG. 3, in one non-limiting embodiment, the valve 10 may be used to create or diffuse a differential pressure between a fluid source in a subsurface environment and an environment in a well tool 100. The fluid source may be fluid in a borehole 102 or a fluid reservoir residing in a formation 108. The well tool 100 may be a bottomhole drilling assembly, a fluid sampling tool, a coring tool, or any other tool that is configured or performs one or more tasks (e.g., forming the borehole, sampling/testing formation solids or fluids, etc.) in the borehole 102. A sample from the formation 108 may be retrieved using a packer-type probe 12 that engages a wall of the borehole 102 to isolates the fluid in the formation 108 from the borehole fluid 104. In other embodiments not shown, one or more annular packers may be used to isolate a zone in the borehole 102. The isolated borehole zone may fill with a formation fluid. In either case, the valve 10 may be used to convey a fluid sample retrieved from the isolated zone to a sample bottle 110 or other similar receptacle. The well tool 100 may be conveyed via a work string 106, which may include a rigid carrier (e.g., drill string, casing, liner, etc.) or non-rigid carrier (e.g., wireline, slickline, e-line, etc.).

Referring now to FIGS. 1A and 3, in one mode of use, the well tool 100 may be conveyed into a borehole 102 to retrieve one or more fluid samples. After being appropriately positioned, a hydraulic source (not shown) pressurizes the pressure chamber 26*a* via the pilot inlet 28*a* with a hydraulic fluid to urge the mandrel 30 in an axial direction marked with arrow 43. This action sets the valve 10 in an open position and allows a retrieved fluid, which may be a liquid, a gas, or a mixture thereof, to flow to the fluid outlet 24 via the fluid inlet 22 and the passage 48. The retrieved fluid, or fluid "sample," may be collected in a sample receptacle 110. It should be appreciated that during the sampling activity, the valve 10 may be considered pressure balanced. That is, the fluid pressure at the fluid inlet 22 is applied to the seal 62 above and the seal 64 below the fluid inlet 22. This balanced pressure reduces the likelihood that the mandrel 30 will move due to pressure fluctuations.

To terminate the sampling operation, the hydraulic source (not shown) pressurizes the pressure chamber 26*b* via the pilot inlet 28*b* to urge the mandrel 30 in an axial direction marked with arrow 45, which sets the valve 10 in the closed position.

Referring now to FIGS. 1B and 2, in the closed position, fluid pressure at the fluid inlet 22 generates a pressure differential across the seal 40. The differential between the pressure at the fluid source and the interior of the well tool 100 may approach twenty-five thousand PSI. This pressure compresses the seal 40 against the support 47. Specifically, the upper end adapter 48*a* compresses the spring stack 50*a* against the center adapter 52. The center adapter 52 communicates this pressure to the seal stack 50*b*. This compression causes the ring(s) 54 to expand and compress the tips 60 of the wings 56 to engage and seal against an adjacent surfaces 44, 46. It should be appreciated that an increase in pressure causes a corresponding increase in the sealing force at the contact between the wings 56 and the adjacent surfaces 44, 46. The resulting seal may be a gas-tight seal. Moreover, in instances where multiple seal rings 54 are used, multiple independent sealing contacts are formed. It should also be appreciated that this gas-tight seal is obtained without applying a sealing agent at the contacting surfaces (e.g., grease).

It should be appreciated that when the seal 40 isolates an inflowing fluid sample from surrounding fluid during retrieval, the seal 40 prevents the inflowing fluid from leaking out of the passage 48. When preserving a retrieved fluid sample as the tool is being returned to the surface, the seal 40 prevents the fluid sample from leaking into the passage 48. Thus, the seal 40 has bidirectional sealing capability. However, it should be understood that if a separate seal is used to prevent either fluid leaking into or out of the passage 48, then the seal 40 does not need to be bidirectional and only one seal stack may be used.

Also, in certain embodiments, an actuator 75 may be used to allow pressurized fluid to escape or bleed from the pressure chamber 26*b*. The actuator 75 may be used to manually close the valve 10. For instance, if the valve 10 is in the open position shown in FIG. 1A, the actuator 75 may be partially or completely removed to allow hydraulic fluid to escape, which would allow the valve 10 to shift to the closed position in FIG. 1B. In some embodiments, the actuator 75 may be a threaded body that is screwed into the housing 20.

While the foregoing disclosure is directed to the one mode embodiments of the disclosure, various modifications will be apparent to those skilled in the art. For example, while a hydraulic source is shown for moving the mandrel, an electric motor may also be used to translate the mandrel. Also, in certain embodiments, a unidirectional seal may be used to form an adequate seal. It is intended that all variations be embraced by the foregoing disclosure.

We claim:

1. An apparatus for controlling a fluid flow in a borehole, the apparatus comprising: a tool body configured to retrieve a fluid sample from a subsurface formation, the tool body having a fluid conduit having an inlet for receiving the fluid sample and an outlet for conveying the fluid sample to a selected location; a mandrel selectively blocking flow along the fluid conduit, the mandrel having a reduced exterior diameter portion; and a seal disposed on the mandrel, the seal including at least one chevron seal element: the seal and the mandrel having: (i) a first position wherein fluid flow is blocked between the seal and the mandrel; and (ii) a second position wherein a fluid flows between the seal and the mandrel and along the reduced diameter portion configured to cooperate with the mandrel to selectively block flow across the fluid conduit.

2. The apparatus of claim 1 wherein the seal includes at least two seal stacks, each seal stack including at least one chevron seal element.

3. The apparatus of claim 2 further comprising a center adapter positioned between the at least two seal stacks, and a pair of end adapters positioned on opposing ends of the seal.

4. The apparatus of claim 3 wherein the end adapters compress the chevron seal elements in response to a fluid pressure at at least one of: (i) the inlet, and (ii) the outlet.

5. The apparatus of claim 1 wherein the seal is bidirectional.

6. The apparatus of claim 1 wherein the at least one chevron seal element is formed of a metal.

7. The apparatus of claim 1 wherein the seal is formed of a metal and a non-metal.

8. The apparatus of claim 1, wherein the tool body includes:

a chamber in which the mandrel is disposed;

a pressure chamber formed at each opposing end of the chamber; and a pilot hole in communication with each pressure chamber, wherein the mandrel is configured to translate in the chamber in response to pressure applied by each pressure chamber.

9. The apparatus according to claim 1, further comprising a carrier configured to convey the tool body into the borehole.

10. The apparatus of claim 1, wherein the tool body includes:

a chamber in which the mandrel is disposed, wherein the seal is stationary in the chamber; and a pressure chamber formed at each opposing end of the chamber, wherein the mandrel is configured to translate in the chamber in response to pressure applied by each pressure chamber.

11. The apparatus of claim 1, wherein an annular passage separates the seal and the mandrel in the second position, wherein the fluid flows through the annular passage.

12. A method for controlling a fluid flow in a borehole, comprising:

retrieving a fluid sample from a subsurface formation using a tool body, the tool body having a fluid conduit having an inlet for receiving the fluid sample and an outlet for conveying the fluid sample to a selected location;

selectively blocking flow along the fluid conduit using a mandrel having a reduced exterior diameter portion;

isolating the inlet from the outlet using a seal positioned in a passage between the mandrel and the tool body, the seal including at least one chevron seal element; and allowing a fluid flow between the inlet and the outlet by moving the reduced diameter portion directly adjacent to the seal.

13. The method of claim 12 wherein the seal includes at least two seal stacks, each seal stack including at least one chevron seal element.

14. The method of claim 13 wherein a center adapter is positioned between the at least two seal stacks, and a pair of end adapters are positioned on opposing ends of the seal.

15. The method of claim 14 further comprising compressing the chevron seal elements using the end adapters in response to a fluid pressure at at least one of: (i) the inlet, and (ii) the outlet.

16. The method of claim 12 wherein the seal is bidirectional.

17. An apparatus for controlling a fluid flow in a borehole, the apparatus comprising:

a carrier configured to be conveyed along a borehole;

a tool body positioned along the carrier, the tool body having at least one packer configured to form an isolated zone, the tool body having a fluid conduit having an inlet for receiving a fluid sample from the isolated zone, and an outlet for conveying the fluid sample to a selected location; and a valve disposed in the tool body, the valve including:

a mandrel configured to translate between a first and a second position to selectively block flow across the fluid conduit, the mandrel having a reduced exterior diameter portion; and a seal disposed on the mandrel, the seal including at least one chevron seal element wherein fluid flow is blocked between the seal and the mandrel in the first position and a fluid flows between the seal and the mandrel and along the reduced diameter portion in the second position.

18. The apparatus of claim 17, further comprising a plurality of seals disposed on the mandrel, the plurality of seals isolating the fluid conduit from the rest of the tool body when fluid flows between the inlet and the outlet.

19. The apparatus of claim 17, wherein the at least one chevron seal element includes two wings that are hinged at an apex.

* * * * *